US006476778B1

(12) United States Patent
Hussaini et al.

(10) Patent No.: US 6,476,778 B1
(45) Date of Patent: Nov. 5, 2002

(54) REMOTELY CONTROLLED RETRACTABLE POWER ANTENNA

(75) Inventors: Saied Hussaini, Miami, FL (US); Marc Iacovelli, Miami, FL (US)

(73) Assignee: Rally Manufacturing Inc., Miami, FL (US)

( * ) Notice: Subject to any disclaimer, the term of this patent is extended or adjusted under 35 U.S.C. 154(b) by 0 days.

(21) Appl. No.: 09/516,027

(22) Filed: Feb. 29, 2000

(51) Int. Cl.[7] ..... H01Q 1/10

(52) U.S. Cl. ..... 343/901; 343/702; 343/711; 343/714

(58) Field of Search ..... 340/436, 457, 340/435, 825.69; 343/901, 904, 905, 906, 907, 711, 712, 715, 903, 877, 702, 705, 714; 293/128; 318/16, 98, 103, 671, 675

(56) References Cited

U.S. PATENT DOCUMENTS 4,506,266 A * 3/1985 Mizuno et al. ..... 343/715
4,848,823 A * 7/1989 Flohr et al. ..... 296/98
5,276,426 A * 1/1994 Lobello ..... 340/436
5,438,312 A * 8/1995 Lewis ..... 340/457
5,518,283 A * 5/1996 Egelske ..... 293/128
5,600,302 A * 2/1997 Lewis ..... 340/457
6,066,026 A * 5/2000 Bart et al. ..... 180/6.2
6,075,330 A * 6/2000 Terk ..... 318/280
6,239,744 B1 * 5/2001 Singer et al. ..... 342/359

* cited by examiner

*Primary Examiner*—Don Wong
*Assistant Examiner*—Chuc Tran
(74) *Attorney, Agent, or Firm*—Liniak, Berenato & White

(57) ABSTRACT

A wireless remotely controlled power retractable antenna for a vehicle radio system. A power retractable antenna is provided with a receiver/controller. Rather than rely on signals from the radio or other hard-wired device, the receiver/controller is adapted to receive a signal from a hand held transmitter. The hand held transmitter has up and down buttons for sending a specific signal representative of the desired antenna position. When it is desired to raise the antenna, the up button is depressed and the transmitter sends an up signal to the receiver/controller. When the antenna is desired in the down position, the down button is simply depressed and the transmitter sends a down signal to the receiver/controller. The controller operates a motor to drive the antenna in accordance with the received signal.

8 Claims, 1 Drawing Sheet

REMOTELY CONTROLLED RETRACTABLE POWER ANTENNA

BACKGROUND OF THE INVENTION

1. Field of the Invention

This invention is directed to a retractable power antenna and is particularly is directed to a power antenna having wireless remote controlled activation.

2. Description of the Prior Art

Vehicle power retractable antennas are well known in the art. A retractable power antenna is mounted on the vehicle and is wired to the vehicle radio. When the radio is turned on, power is delivered to extend the antenna. When the radio is turned off, the antenna is retracted. Such antennas are well known in the art. U.S. Pat. Nos. 4,829,317, 4,825,226, 4,733,101 and 4,591,868 each discloses such power retractable antennas and are hereby incorporated herein by reference. Such conventional power antennas are often difficult to install as the antenna power unit requires a physical wire connection to the radio in addition to the antenna connection. Moreover, some radios, particularly older radios, are not equipped with a power antenna signal connection. Therefore, retrofitting a power retractable antenna with these radios is not feasible. Even modern radio units equipped with a connection for a power antenna requires that a wire be strung through the vehicle from the power antenna mounting behind the instrument panel and connected to the radio system. Such installation is timely and costly. The object of the present invention is to provide a wireless remote control of a power retractable radio antenna. This is particularly beneficial in installations where the previous antenna is fixed or manually retractable with no pre-existing wiring for a conventional power antenna.

It is also well known in the art to use wireless switching devices to remotely activate accessories within an automotive vehicle. Such devices are incorporated into keyless entry systems whereby an operator carries a small portable transmitter that selectively sends a radio signal to a control device in the vehicle to selectively operate vehicular accessories such as door locks, a power switch for the vehicle ignition and starter, or to disable a starting system. Two such keyless entry systems are disclosed in U.S. Pat. Nos. 5,689,142 and 4,672,375 and are hereby incorporated herein by reference.

It is the object of the present invention to improve on the power retractable antennas of the prior art. Specifically, it is the object of the present invention to incorporate a wireless remote control to a power retractable antenna system.

SUMMARY OF THE INVENTION

The present invention is directed to a wireless remotely controlled power retractable antenna for a vehicle radio system. A power retractable antenna is provided with a receiver/controller. Rather than rely on signals from the radio, or other hard-wired device, the receiver/controller is adapted to receive a signal from a hand held transmitter. The hand held transmitter has up and down buttons for sending a specific signal representative of the desired antenna position. When it is desired to raise the antenna, the up button is depressed and the transmitter sends an up signal to the receiver/controller. When the antenna is desired in the down position, the down button is simply depressed and the transmitter sends a down signal to the receiver/controller. The controller operates a motor to drive the antenna in accordance with the received signal.

DESCRIPTION OF THE PREFERRED EMBODIMENT

Figure 1A:
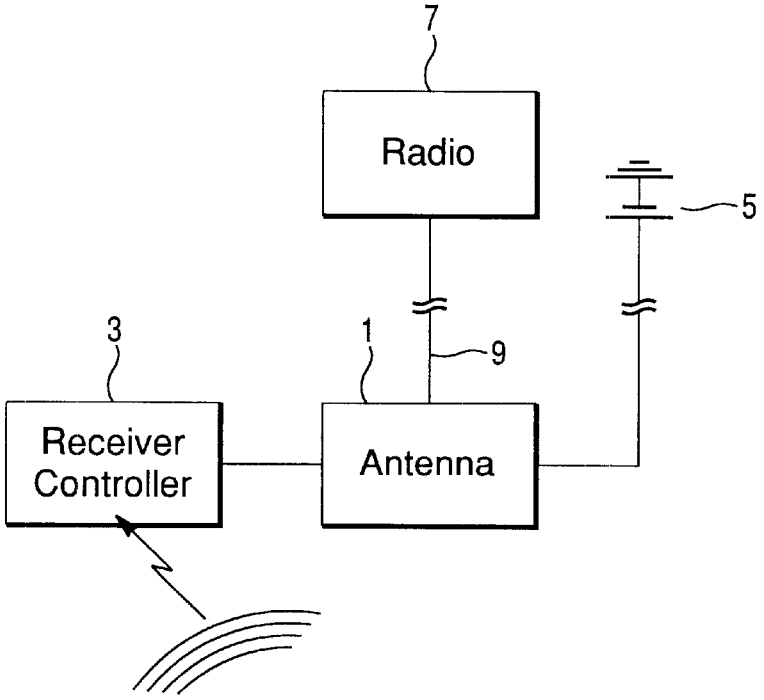
FIGS. 1A & 1B is a schematic view of the power retractable antenna connected to a vehicle radio and wireless remote transmitter respectively.
Figure 1B:
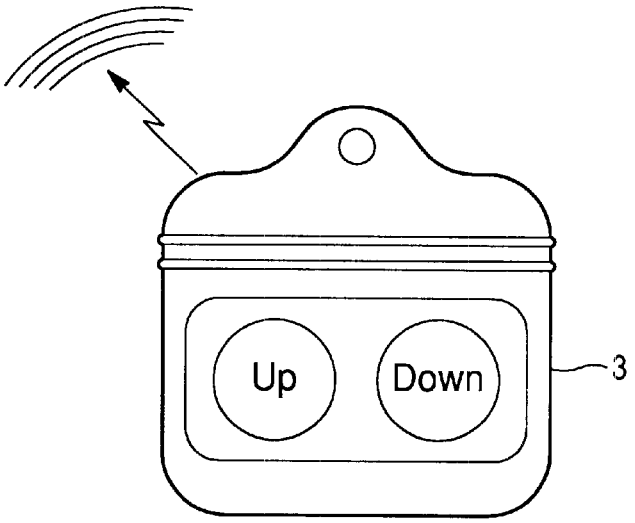

FIG. 1A & 1B depict the power retractable antenna and wireless transmitter according to the present invention. A power antenna unit 1, as is conventionally found in the art, is mounted to the vehicle. The power antenna unit comprises an extendable/retractable antenna driven by an electric motor as is conventional found in the art. The antenna 1 is also connected to a coaxial antenna cable 9 leading to the vehicle radio 7 as is well known in the art. The power antenna 1 is also provided with a receiver/controller 3 to control the direction of the motor and position of the antenna. Specifically, the controller 3 controls the motor to position the antenna 1 in either the up fully extended position or the down fully retracted position. Alternately, the controller 3 may provide a means to selectively position the antenna 1 in an intermediate position. The power antenna 1 is also attached to a voltage source 5 such as the vehicle's battery. The antenna 1 is preferably grounded to complete the electrical circuit.

A wireless transmitter, such as those used in keyless entry systems, is provided to send a signal to the receiver/controller 3. Preferably, the wireless transmitter has an up and down button for selectively sending an up and down signal to the receiver/controller 1. When the up button is depressed, an up signal is sent to the receiver/controller and the antenna is extended to the extended position. When the down position is depressed, the wireless transmitter sends a down signal to the receiver/controller 1 and the antenna is accordingly lowered to the retracted position. Alternately a single button can be provided to activate a single signal and the controller programmed to alternatively extend and retract the antenna.

The wireless remotely controlled power retractable antenna of the present invention has specific advantages in the installation process. When retrofitting the antenna of the present invention to replace a previous manual or fixed antenna, the power antenna need only be connected to the existing coaxial antenna cable and a voltage source of the vehicle. Connecting the power antenna to a voltage source is not difficult as it can be secured directly to the vehicle's batter or any 12-volt live wire running through the vehicle. Because, the wireless transmitter controls the power antenna, there is no need to wire the power antenna to the radio 7. This eliminates a timely, costly, and difficult installation process, as wiring behind the instrument panel to the radio system 7 is a difficult task often requires skilled installation professionals. The wireless remote controlled antenna of the present invention also allows easy installation of a power retractable antenna to a radio 7 not equipped with a special power antenna outlet. The small transmitter 3 may then be attached to the vehicles key or key chain, or be mounted to the vehicle dashboard proximate the radio system for easy access.

When retrofitting the power antenna of the present invention, the existing antenna need only be removed and disconnected from the existing antenna cable. The power antenna of the present invention is provided and connected to the existing antenna and wired to a voltage source of the vehicle. The power antenna is then simply mounted proximate the position of the pre-existing antenna.

While the foregoing invention has been shown and described with reference to a preferred embodiment, it will be understood by those possessing skill in the art that various changes and modifications may be made without departing from the spirit and scope of the invention.

What is claimed is:

1. An antenna system for a vehicle radio comprising:

a power driven extendable antenna unit comprising a receiver/controller, said receiver/controller provided to control a position of said antenna unit in response to wireless signal; and a wireless transmitter provided to send said wireless signal to selectively control said position of said antenna unit.

2. The antenna system according to claim 1, wherein wireless transmitter includes an up button and a down button to selectively activate transmission an up signal and a down signal respectively, said receiver/controller being equipped to extend said antenna unit to an extended position in response to said up signal and retract said antenna to a retracted position in response to said down signal.

3. The antenna system according to claim 1, further comprising:

a coaxial antenna cable disposed between and interconnecting said power driven extendable antenna unit and said vehicle radio.

4. The antenna system according to claim 1, wherein said wireless transmitter is a portable hand held device.

5. A method of retrofitting a power antenna to an existing antenna mounted to a pre-existing position on a vehicle and connected to an antenna cable leading to a radio system, said method comprising the steps of:

providing a power antenna unit provided with a receiver/controller to receive a wireless signal from a transmitter device to control a position of an extendable antenna member in response to said signal, disconnecting said existing antenna from said antenna cable and said vehicle;

connecting said antenna member to said antenna cable;

connecting said power antenna unit to a voltage source of said vehicle; and mounting said power antenna unit to said vehicle proximate said pre-existing position.

6. An antenna system for a vehicle radio comprising:

a power driven extendable antenna unit connected to said vehicle radio;

a wireless transmitter provided to transmit a wireless signal;

a receiver/controller provided to receive said wireless signal and control a position of said power driven extendable antenna unit in response to said wireless signal.

7. The antenna system according to claim 6, wherein said wireless transmitter includes an up button and a down button to selectively activate transmission of an up signal and a down signal respectively, said receiver/controller being equipped to extend said antenna unit to an extended position in response to said up signal and retract said antenna to a retracted position in response to said down signal.

8. The antenna system according to claim 4, wherein said wireless transmitter is a portable hand held device.

* * * * *